US010982305B2

(12) United States Patent
Hwang et al.

(10) Patent No.: US 10,982,305 B2
(45) Date of Patent: Apr. 20, 2021

(54) SAMARIUM-CONTAINING SOFT MAGNETIC ALLOYS

(71) Applicant: TAIWAN POWDER TECHNOLOGIES CO., LTD., Taoyuan (TW)

(72) Inventors: Kuen-Shyang Hwang, Taipei (TW); Guo-Jiun Shu, Taipei (TW); Fang-Cheng Chou, Taipei (TW)

(73) Assignees: TAIWAN POWDER TECHNOLOGIES CO., LTD., Taoyuan (TW); CHINA POWDER TECHNOLOGIES CO., LTD., Suzhou (CN); HPM LABS CO., LTD., Taipei (TW)

( * ) Notice: Subject to any disclaimer, the term of this patent is extended or adjusted under 35 U.S.C. 154(b) by 229 days.

(21) Appl. No.: 16/046,184

(22) Filed: Jul. 26, 2018

(65) Prior Publication Data

US 2019/0048442 A1 Feb. 14, 2019

Related U.S. Application Data

(60) Provisional application No. 62/539,013, filed on Jul. 31, 2017.

(51) Int. Cl.
*H01F 1/147* (2006.01)
*C22C 38/12* (2006.01)
(Continued)

(52) U.S. Cl.
CPC ..... *C22C 38/12* (2013.01); *C22C 30/00* (2013.01); *C22C 38/005* (2013.01); *H01F 1/147* (2013.01); *C22C 2202/02* (2013.01)

(58) Field of Classification Search
None
See application file for complete search history.

(56) References Cited

U.S. PATENT DOCUMENTS 1,739,752 A 12/1929 Elmen
1,862,559 A 6/1932 White
(Continued)

FOREIGN PATENT DOCUMENTS

CN 101921973 B * 3/2013

OTHER PUBLICATIONS

Machine translation of CN101921973B. (Year: 2013).*

*Primary Examiner* — Xiaowei Su
(74) *Attorney, Agent, or Firm* — Muncy, Geissler, Olds & Lowe, P.C.

(57) ABSTRACT

The present teaching is generally directed to soft magnetic alloys. In particular, the present teaching is directed to soft magnetic alloys including Samarium ("Sm"). In a non-limiting embodiment, an Sm-containing magnetic alloy is described including 15 wt % to 55 wt % of Cobalt ("Co"), less than 2.5 wt % of Sm, and 35 wt % to 75 wt % of Iron ("Fe"). The Sm-containing magnetic alloy may further include at least one element X, selected from a group including Vanadium ("V"), Boron ("B"), Carbon ("C"), Chromium ("Cr"), Manganese ("Mn"), Molybdenum ("Mo"), Niobium ("Nb"), Nickel ("Ni"), Titanium ("Ti"), Tungsten ("W"), and Silicon ("Si"). The Sm-containing magnetic alloy may further have a magnetic flux density of at least 2.5 Tesla.

1 Claim, 2 Drawing Sheets

(51) Int. Cl.
*C22C 30/00* (2006.01)
*C22C 38/00* (2006.01)

(56) References Cited

U.S. PATENT DOCUMENTS

| | | | | |
|---|---|---|---|---|
| 4,933,026 | A | 6/1990 | Rawlings et al. | |
| 5,252,940 | A | 10/1993 | Tanaka | |
| 6,132,892 | A * | 10/2000 | Yoshikawa | B82Y 10/00 204/192.2 |
| 6,685,882 | B2 | 2/2004 | Deevi et al. | |
| 6,946,097 | B2 | 9/2005 | Deevi et al. | |
| 7,776,259 | B2 | 8/2010 | Deevi et al. | |

* cited by examiner

SAMARIUM-CONTAINING SOFT MAGNETIC ALLOYS

CROSS-REFERENCE TO RELATED APPLICATION

The present application claims the benefit of U.S. Provisional Patent Application No. 62/539,013, entitled "Samarium-Containing Soft Magnetic Alloys," which was filed on Jul. 31, 2017, and the disclosure of which is incorporated herein by reference in its entirety.

FIELD OF INVENTION

The present teachings are generally directed to Samarium ("Sm")-containing soft magnetic alloys. In particular, the present teachings are generally directed to Sm-containing soft magnetic alloys having a high saturated magnetic flux density.

BACKGROUND

Of the various types of soft magnets, Iron ("Fe")-Cobalt ("Co") alloys are one of the more prominent versions. As seen within U.S. Pat. No. 1,739,752, a soft magnetic Fe—Co alloy is described having a high magnetic flux density ("B"). However, the Fe—Co alloy of U.S. Pat. No. 1,739,752 is extremely brittle due to the presence of a' below approximately 730-degrees C. This undesirable property makes the Fe—Co alloy of U.S. Pat. No. 1,739,752 unsuitable for certain industrial purposes, such as the production of plates, sheets, bars, tubes, and other objects that require good processability.

The addition of Vanadium ("V") to the aforementioned Fe—Co alloys was determined to effectivity inhibit $\alpha$ to $\alpha'$ phase transformation. Also, the addition of V to Fe—Co alloys caused an increase to the alloy's resistivity, reducing eddy current loss. However, the addition of V to Fe—Co alloys results in a lowered magnetic flux density. Such Fe—Co—V alloys are described in U.S. Pat. No. 1,862,559.

Adding in other alloying elements to Fe—Co alloys was found to introduce similar negative effects (e.g., lowered magnetic flux density). However, in comparison to other alloying elements, the addition of V to Fe—Co alloys had a less significant magnetic flux density decrease. At the same time, the Fe—Co—V alloys were determined to have enhanced mechanical properties and processability relative to other alloying elements. Thus, while there is some reduction in magnetic flux density, Fe—Co—V alloys are commonly used and accepted for manufacturing soft magnets having high magnetic flux densities, low eddy current loss, good mechanical properties, and high processability. In particular, the composition of such commonly used Fe—Co—V alloys, which have a good balance between magnetic flux density, resistivity, and mechanical properties, include approximately 47 wt % to 52 wt % of Co, approximately 2 wt % of V, with the remainder being Fe (and inevitable impurities).

Further modifications to Fe—Co—V alloys, such as those having approximately 50 wt % of Co and approximately 2 wt % of V, also have been developed. For instance, U.S. Pat. No. 5,252,940 describes a Fe—Co—V alloy, having approximately 2.1 wt % to 5 wt % of V, which has an improved energy efficiency under greatly fluctuating direct current conditions by reducing eddy currents. U.S. Pat. No. 4,933,026 further describes an Fe—Co—V alloy having 0.1 wt % to 2.0 wt % of Niobium ("Nb"), which provides good ductility. Further still, U.S. Pat. Nos. 6,685,882, 6,946,097, and 7,776,259 describe Fe—Co—V alloys further including an addition of Boron ("B"), Carbon ("C"), Molybdenum ("Mo"), Nb, Nickel ("Ni"), Titanium ("Ti"), and Tungsten ("W"), which facilitates an alloy having high strength and high temperature creep resistance.

There are many examples of conventional Fe—Co—Vo alloys, such as those described above, in industrial settings. For instance, one commercial alloy—Hyperco 50HS alloy available from Carpenter Technology Corporation—includes 48.75 wt % Co, 1.90 wt % V, 0.30 wt % Nb, 0.05 wt % Si, 0.05 wt % Manganese ("Mn"), and 0.01 wt % C, with the remaining balance being Fe. Another commercial alloy—Hyperco 50A also available from Carpenter Technology Corporation—includes 48.75 wt % Co, 2.00 wt % V, 0.05 wt % Si, 0.05 wt % Mn, and 0.004 wt % C, with the remaining balance being Fe. Additional commercial alloys include Vacoflux 48 and Vacodur 49, from Vacuumschmelze Gmbh & Co., which respectively include 49 wt % Fe, 49 wt % Co, and 2 wt % V; and 49 wt % Fe, 49 wt % Co, and 2 wt % V+Nb.

Each of the aforementioned alloys has certain benefits, such as improved electrical and mechanical properties. However, most of these alloys achieve such improved electrical and mechanical properties at the expense of certain magnetic properties, such as magnetic flux density. By sacrificing magnetic flux density, the applicability of such alloys is limited. Thus, there is a need for improved magnetic alloys, such as those of the Fe—Co—V variety, that provide increased magnetic flux density and increased resistivity while also having good mechanical properties.

SUMMARY

The present teaching is generally directed to soft magnetic alloys. In particular, the present teaching is directed to Sm-containing soft magnetic alloys having increased magnetic flux densities.

In one example, an Sm-containing magnetic alloy is described. The Sm-containing magnetic alloy may include 15 wt % to 55 wt % of Co, less than 2.5 wt % of Sm, and 35 wt % to 75 wt % of Fe.

In another example, an Sm-containing magnetic alloy is described. The Sm-containing magnetic alloy may include 15 wt % to 55 wt % of Co, less than 2.5 wt % of Sm, 0.001 wt % to 10 wt % of V, and 35 wt % to 75 wt % of Fe.

In yet another example, an Fe—Co magnetic alloy is described. The Fe—Co magnetic alloy may include 0.1 wt % to 2.5 wt % of Sm and a magnetic flux density of at least 2.5 Tesla.

BRIEF DESCRIPTION OF THE DRAWINGS

The materials described herein are further detailed in terms of exemplary embodiments. The exemplary embodiments are described with reference to the drawings. These embodiments are non-limiting exemplary embodiments, wherein.

DETAILED DESCRIPTION

Figure 1:
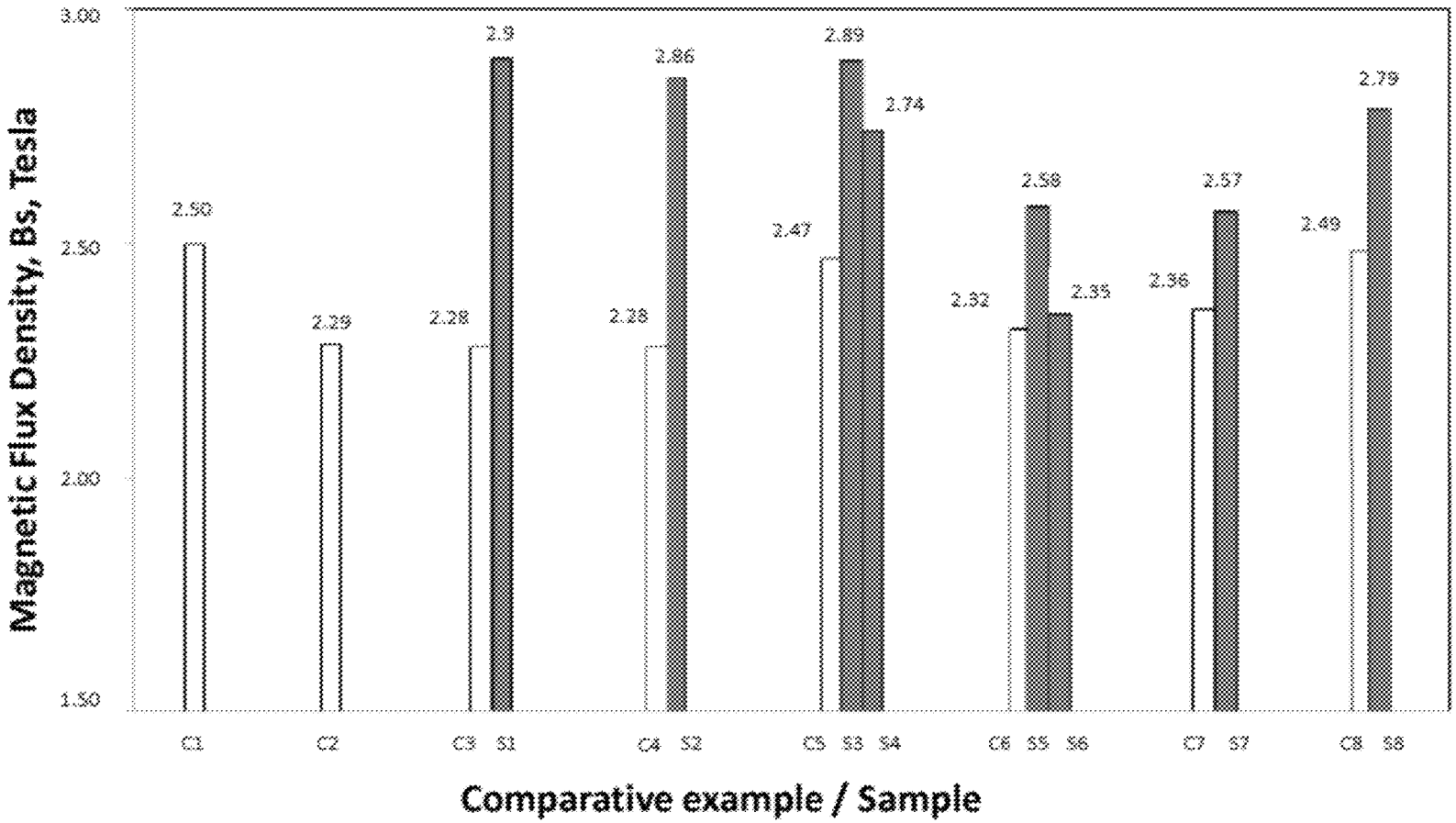
FIG. 1 is an illustrative graph describing a comparison of magnetic flux densities of sample materials free of Sm with sample materials including Sm, in accordance with various embodiments of the present teachings.

The present teaching is generally directed to magnetic alloys, and in particular, to magnetic alloys which overcome the limitations associated with conventional Fe—Co—V magnetic alloys. In particular, the present teaching is generally directed to overcoming the technical problems associated with conventional soft magnetic alloys that sacrifice magnetic flux density in order to improve electrical and mechanical properties associated with these alloys.

One exemplary improved magnetic alloy may be achieved by including Sm into the magnetic alloy. By including Sm, soft magnetic alloys may be achieved having increased magnetic flux densities and resistivity as compared to conventional Fe—Co—V magnetic alloys (as described above), and also having good mechanical properties. The improved magnetic alloy may be used for a variety of industrial applications such as, and without limitation, track pads for mobile devices, high-end headphones, high performance motors for electric vehicles, and advanced power-generating units.

As a non-limiting example, a soft magnetic alloy including Sm is described herein. The Sm-including soft magnetic alloy may be characterized by including 0.1 wt % to 2.5 wt % of Sm, and a magnetic flux density of at least (approximately) 2.5 T. As an illustrative example, in addition to Sm at the aforementioned amounts, the soft magnetic alloy may also include Co and Fe, as detailed below. The exemplary soft magnetic alloy including Sm may achieve good mechanical and electrical properties, while also having good magnetic properties (e.g., Bs≥2.5 T).

In one embodiment, the magnetic alloy may include 15 wt % to 55 wt % of Co, 0.1 wt % to 2.5 wt % of Sm, at least one 0.001 wt % to 10 wt % of X, and 35 wt % to 75 wt % of Fe, where X is selected from a group including V, B, C, Chromium ("Cr"), Mn, Mo, Nb, Ni, Ti, W, and Silicon ("Si"). However, persons of ordinary skill in the art will recognize that the aforementioned group may include more or fewer elements. The magnetic alloy of the present embodiment, for instance, may achieve good mechanical properties and good magnetic flux densities.

In another example, a magnetic alloy may include 15 wt % to 55 wt % of Co, 0.1 wt % to 2.5 wt % of Sm, 0.001 wt % to 10 wt % of V, at least one 0.001 wt % to 10 wt % of X, and 35 wt % to 75 wt % of Fe, where X is selected from a group including B, C, Cr, Mn, Mo, Nb, Ni, T, W, and Si. Persons of ordinary skill in the art will recognize that the aforementioned group may include more or fewer elements. The magnetic alloy of the present embodiment, for instance, may achieve increased magnetic flux densities compared to conventional Fe—Co—V soft magnetic alloys caused by the addition of other alloying elements to improve electrical and mechanical properties.

To illustrate the improvements of the present teaching, sample alloys having various compositions were prepared. In some embodiments, the samples were prepared via arc melting, however other preparation means (e.g., powder metallurgy and induction melting, followed by rolling or forging) are also possible. Compositions based on the present teachings may be manufactured into a powder, a thin film, nanocrystalline grains, and/or amorphous materials, however this list is not meant to be limiting.

In order to measure the susceptibility of the various samples described herein, a superconducting quantum interference device ("SQUID") magnetometer may be employed. The resistivity of a sample may be measured using a four-point probe method, with a sample size being approximately 4 mm by 1.5 mm by 0.3 mm.

The improvement afforded by the present teaching may exemplified by illustrative Tables 1a and 1b, which describe weight percentages (wt %) and atomic percentages (at %), respectively, of various embodiments (S1-S8) formed in accordance with the present teachings and comparative examples (C1-C8).

TABLE 1a

| | Fe wt % | Co wt % | Sm wt % | V wt % | Nb wt % | Mo wt % | Mn wt % | Si wt % |
|---|---|---|---|---|---|---|---|---|
| C1 | 58.70 | 41.30 | 0.0 | 0.0 | 0.0 | 0.0 | 0.0 | 0.0 |
| C2 | 57.53 | 40.47 | 0.0 | 2.0 | 0.0 | 0.0 | 0.0 | 0.0 |
| C3 | 57.82 | 40.68 | 0.0 | 1.5 | 0.0 | 0.0 | 0.0 | 0.0 |
| S1 | 57.67 | 40.58 | 0.25 | 1.5 | 0.0 | 0.0 | 0.0 | 0.0 |
| C4 | 58.41 | 41.09 | 0.0 | 0.5 | 0.0 | 0.0 | 0.0 | 0.0 |
| S2 | 57.97 | 40.78 | 0.75 | 0.5 | 0.0 | 0.0 | 0.0 | 0.0 |
| C5 | 49.64 | 48.36 | 0.0 | 2.0 | 0.0 | 0.0 | 0.0 | 0.0 |
| S3 | 49.14 | 47.86 | 1.0 | 2.0 | 0.0 | 0.0 | 0.0 | 0.0 |
| S4 | 48.83 | 47.57 | 1.6 | 2.0 | 0.0 | 0.0 | 0.0 | 0.0 |
| C6 | 45.26 | 51.74 | 0.0 | 3.0 | 0.0 | 0.0 | 0.0 | 0.0 |
| S5 | 44.79 | 51.21 | 1.0 | 3.0 | 0.0 | 0.0 | 0.0 | 0.0 |
| S6 | 44.32 | 50.68 | 2.0 | 3.0 | 0.0 | 0.0 | 0.0 | 0.0 |
| C7 | 48.83 | 47.57 | 0.0 | 2.0 | 0.8 | 0.8 | 0.0 | 0.0 |
| S7 | 48.07 | 46.83 | 1.5 | 2.0 | 0.8 | 0.8 | 0.0 | 0.0 |
| C8 | 49.39 | 48.11 | 0.0 | 1.8 | 0.3 | 0.3 | 0.05 | 0.05 |
| S8 | 48.07 | 46.83 | 1.3 | 1.8 | 0.3 | 0.3 | 0.05 | 0.05 |

TABLE 1b

| | Fe at % | Co at % | Sm at % | V at % | Nb at % | Mo at % | Mn at % | Si at % |
|---|---|---|---|---|---|---|---|---|
| C1 | 60.00 | 40.0 | 0.0 | 0.0 | 0.0 | 0.0 | 0.0 | 0.0 |
| C2 | 58.66 | 39.11 | 0.0 | 2.24 | 0.0 | 0.0 | 0.0 | 0.0 |
| C3 | 58.99 | 39.33 | 0.0 | 1.68 | 0.0 | 0.0 | 0.0 | 0.0 |
| S1 | 58.93 | 39.29 | 0.10 | 1.68 | 0.0 | 0.0 | 0.0 | 0.0 |
| C4 | 59.66 | 39.78 | 0.0 | 0.56 | 0.0 | 0.0 | 0.0 | 0.0 |
| S2 | 59.49 | 39.66 | 0.29 | 0.56 | 0.0 | 0.0 | 0.0 | 0.0 |
| C5 | 50.83 | 46.92 | 0.0 | 2.24 | 0.0 | 0.0 | 0.0 | 0.0 |
| S3 | 50.63 | 46.73 | 0.38 | 2.26 | 0.0 | 0.0 | 0.0 | 0.0 |
| S4 | 50.50 | 46.62 | 0.61 | 2.27 | 0.0 | 0.0 | 0.0 | 0.0 |
| C6 | 46.38 | 50.25 | 0.0 | 3.37 | 0.0 | 0.0 | 0.0 | 0.0 |
| S5 | 46.19 | 50.04 | 0.38 | 3.39 | 0.0 | 0.0 | 0.0 | 0.0 |
| S6 | 45.99 | 49.83 | 0.77 | 3.41 | 0.0 | 0.0 | 0.0 | 0.0 |
| C7 | 50.32 | 46.44 | 0.0 | 2.26 | 0.50 | 0.48 | 0.0 | 0.0 |
| S7 | 50.00 | 46.16 | 0.58 | 2.28 | 0.50 | 0.48 | 0.0 | 0.0 |
| C8 | 50.69 | 46.78 | 0.0 | 2.02 | 0.18 | 0.18 | 0.05 | 0.10 |
| S8 | 50.41 | 46.53 | 0.50 | 2.04 | 0.19 | 0.18 | 0.05 | 0.10 |

As seen from Tables 1a and 1b, the various embodiments described by samples S1-S8 each include Fe, Co, V, and Sm. Additionally, samples S1-S8 include other elements, such as Mn, Mo, Nb, and Si. Persons of ordinary skill in the art will recognize that the employment of Mn, Mo, Nb, and Si is not intended to be limiting. Furthermore, as illustrated within Tables 1a and 1b, samples S1-S8 of the present teachings each include Sm less than (or equal to) 2.5 wt %. In particular, the amount of Sm may be, preferably, in one embodiment, 0.25 wt % to 2.0 wt %. Persons of ordinary skill in the art will further recognize that the values listed within the tables and described herein may be approximate, as the exact weight (and/or atomic) percentages may vary slightly from sample to sample. For example, the amount of Sm may be 0.25 wt % to 2.0 wt % with an error margin of $\pm\sigma$, where $\sigma$ may be determined via experimentation. In one non-limiting example, $\sigma$ may be equal to 0.1-0.5 wt %, however this is merely illustrative.

In one embodiment, Table 1a may be organized into four groups: group 1, group 2, group 3, and group 4.

Group 1 may include embodiments associated with samples S1 and S2. Each of samples S1 and S2, as seen with respect to Table 1a, may have an Fe content greater than 50 wt %. For example, sample S1 has 57.67 wt % of Fe, and sample S2 has 57.97 wt % of Fe.

Group 2 may include embodiments associated with samples S3 and S4. Each of samples S3 and S4, as seen with respect to Table 1a, may have an Fe and Co content less than 50 wt %. For example, sample S3 has 49.14 wt % of Fe and 47.86 wt % of Co; while sample S4 has 48.83 wt % of Fe and 47.57 wt % of Co.

Group 3 may include embodiments associated with samples S5 and S6. Each of samples S5 and S6, as seen with respect to Table 1a, may have a Co content greater than 50 wt %. For example, sample S5 has 51.21 wt % of Co, and sample S6 has 50.68 wt % of Co.

Group 4 may include embodiments associated with samples S7 and S8. Each of samples S7 and S8, as seen with respect to Table 1a, may have an Fe and Co content based on any of the samples of Groups 1-3; however, samples S7 and S8 may additionally include elements such as Nb, Mo, Mn, and Si. Group 4 may include such additional elements to improve the mechanical properties of the corresponding alloys.

Each of comparative examples C1-C8 may be substantially similar to a corresponding one of samples S1-S8, except that comparative examples C1-C8 may not include Sm. For instance, comparative example C1 may include 58.70 wt % of Fe and 41.30 wt % of Co. The atomic ratio of Fe to Co is approximately 60/40 (or 1.5), and the magnetic flux density and resistivity of comparative example C1 are 2.5 T and 0.15 μΩ·m, respectively. The magnetic flux density of a material corresponds to an amount of magnetic field lines that would otherwise pass through a materials surface. The magnetic flux density, therefore, is related to a magnitude of the magnetic field of a given material through a particular surface of the material, and the area of the surface (as well as the angle of that surface relative to normal). The resistivity of a material indicates how well that material allows electrical current to flow. The resistivity of a material may be related to the product of a material's electrical resistance and a ratio of the materials area to length.

Group 1 Comparison.

Comparative example C2, in the illustrative embodiment, is substantially similar to that of comparative example C1; however, comparative example C2 further includes 2 wt % of V to increase processability, 57.53 wt % of Fe, and 40.47 wt % of Co. For comparative example C2, the ratio of Fe/Co is 58.66/39.11, which remains approximately 1.5 (as is the case for comparative example C1). Looking at FIG. 1, comparative example C1 has a magnetic flux density of 2.5 T, whereas comparative example C2 has a magnetic flux density of 2.29. Thus, the addition of V, such as in comparative example C2, may cause the magnetic flux density to decrease. Furthermore, the resistivity of comparative example C2 is 0.34 μΩ·m, meaning that the addition of V causes an increase in resistivity relative to comparative example C1. In particular, the increase in resistivity may be due to the increase in the number of elements that dissolve in the alloys, thereby enhancing resistivity, which may further advantageously reduce eddy current loss.

Comparative example C3, in the example embodiment, includes 57.82 wt % of Fe, 40.68 wt % of Co, and 1.5 wt % of V. Comparative example C3 may be compared with sample S1, in one embodiment, which is based on comparative example C3 and further includes 0.25 wt % of Sm. For instance, sample S1 includes 57.67 wt % of Fe, 40.58 wt % of Co, 1.50 wt % of V, and 0.25 wt % of Sm. As seen in FIG. 1, the addition of Sm (e.g., 0.25 wt % of Sm) to the composition of comparative example C3, sample S1 exhibits an increase in magnetic flux density. In particular, the magnetic flux density increases from 2.28 T in comparative example C3 to 2.90 T in sample S1. Additionally, the resistivity of comparative example C3 is 0.33 μΩ·, whereas the resistivity of sample S1 is 0.38 μΩ·m. Thus, by adding Sm, and in particular 0.25 wt % of Sm, to the composition of comparative example C3, a substantial increase to magnetic flux density may be achieved by sample S1. This may be due to the extra orbital electrons present in sample S1 due to the added Sm.

Comparative example C4, in another example embodiment, includes 58.41 wt % of Fe, 41.09 wt % of Co, and 0.50 wt % of V. Comparative example C4 may be compared to sample S2, in one embodiment, which is based on comparative example C4 and further includes 0.75 wt % of Sm. For instance, sample S2 includes 57.97 wt % of Fe, 40.78 wt % of Co, 0.50 wt % of V, and 0.75 wt % of Sm. As seen in FIG. 1, the addition of Sm (e.g., 0.75 wt % of Sm) to the composition of comparative example C4, sample S2 also exhibits an increase in magnetic flux density. In particular, the magnetic flux density increases from 2.28 T in comparative example C4 to 2.86 T in sample S2. Additionally, the resistivity of comparative example C4 is 0.24 μΩ·m, whereas the resistivity of sample S2 is 0.31 μΩ·m. Thus, by adding Sm, and in particular 0.75 wt % of Sm, to the composition of comparative example C4, a substantial increase to magnetic flux density may be achieved by sample S2.

In sum, by adding small amounts of Sm to the Fe—Co—V alloys of comparative examples C3 and C4, samples S1 and S2, respectively, are able to achieve increased magnetic flux densities and high resistivity. Thus, group 1, which includes samples where Fe, by wt %, is over 50, and where the ratio of Fe/Co is 1.5, is able to significantly increase magnetic flux densities and increase resistivity by small additions of Sm.

Group 2 Comparison.

Comparative example C5, in another example embodiment, includes 49.64 wt % of Fe, 48.36 wt % of Co, and 2.00 wt % of V. In comparative example C5, the ratio of Fe/Co is 50.83/46.92, which is approximately 1.083. The material structure of comparative example C5, in one embodiment, is substantially similar to Vacoflux 48, as mentioned previously, which is widely used in the industry based on its good magnetic and mechanical properties.

Comparative example C5 may be compared to sample S3, in one embodiment, which is based on comparative example C5 and further includes 1 wt % of Sm. For instance, sample S3 includes 49.14 wt % of Fe, 47.86 wt % of Co, 2.00 wt % of V, and 1.00 wt % of Sm. Comparative example C5 may be compared to sample S4, in one embodiment, which is based on comparative example C5 and further includes 1.60 wt % of Sm. For instance, sample S5 includes 48.83 wt % of Fe, 47.57 wt % of Co, 2.00 wt % of V, and 1.60 wt % of Sm.

As seen in FIG. 1, the addition of Sm (e.g., 1 wt % of Sm for sample S3 and 1.60 wt % of Sm for sample S4) to the composition of comparative example C5 facilitates an increase in magnetic flux density. Furthermore, the resistivity of samples S3 and S4 also increase relative to that of comparative example C5. For example, comparative example C5 has a magnetic flux density of 2.47 T (see FIG. 1) and a resistivity of 0.39 μΩ·m, Sample S3 has a magnetic flux density of 2.89 T and a resistivity of 0.52 μΩ·m. Sample S4 has a magnetic flux density of 2.74 T and a resistivity of 0.61 μΩ·m. In other words, the small addition of Sm to comparative example C5, as demonstrated by samples S3 and S4, significantly increases the magnetic flux density.

The increased magnetic flux density of samples S3 and S4 further corresponds to a highest magnetic flux density of conventional Fe—Co, Fe—Co—V alloys and other known soft magnetic materials, which is a significant improvement over known compositions.

Increasing Sm does not necessarily automatically provide increased magnetic flux density. For example, if, instead of adding 1 wt % or 1.60 wt % of Sm, as is the case for samples S3 and S4, respectively, to the composition of comparison example C5, 2.5 wt % of Sm is added to comparative example C5, the magnetic flux density is 2.48 T. Further, if 3.0 wt % of Sm is added to comparative example C5, the magnetic flux density decreases to 2.05 T. Thus, it is not merely enough to add Sm to comparative example C5 (or other comparative examples), but an appropriate amount of Sm is to be added in order to provide the advantages described herein by the present teachings.

Group 3 Comparison.

Comparative example C6, in another example embodiment, includes 45.26 wt % of Fe, 51.74 wt % of Co, and 3.00 wt % of V. In comparative example C6, the magnetic flux density is 2.32 T.

Comparative example C6 may be compared to sample S5, in one embodiment, which is based on comparative example C6 and further includes 1 wt % of Sm. For instance, sample S5 includes 44.79 wt % of Fe, 51.21 wt % of Co, 3.00 wt % of V, and 1.00 wt % of Sm. Comparative example C6 may also be compared to sample S6, in one embodiment, which is also based on comparative example C6 and further includes 2 wt % of Sm. For instance, sample S6 includes 44.32 wt % of Fe, 50.68 wt % of Co, 3.00 wt % of V, and 2 wt % of Sm.

As seen in FIG. 1, the addition of Sm (e.g., 1 wt % of Sm for sample S5 and 2 wt % of Sm for sample S6) to the composition of comparative example C6 facilitates an increase in magnetic flux density. For example, comparative example C6 has a magnetic flux density of 2.32 T (see FIG. 1). Sample S5 has a magnetic flux density of 2.58 T, and sample S6 has a magnetic flux density of 2.35 T. However, as mentioned above, merely adding Sm to comparative example C6 does not automatically increase magnetic flux density of the resulting material. For example, if, instead of 1 wt % and 2 wt % of Sm, were added to comparative example C6 (as is the case for samples S5 and S6, respectively), 3 wt % of Sm were added, the magnetic flux density of the resulting material would decrease to 2.14 T.

Group 4 Comparison.

In some embodiments, additional elements may be added to the Fe—Co—V alloys to facilitate alloys that have increased mechanical properties (e.g., decrease brittleness). For example, elements such as, but not limited to, Al, C, Cr, Mn, Mo, Nb, Si, Ta, Ti, and/or W may be added to Fe—Co—V alloys of the various types described herein.

Comparative example C7, in yet another example embodiment, includes 48.83 wt % of Fe, 47.57 wt % of Co, 2.00 wt % of V, 0.8 wt % of Nb, and 0.8 wt % of Mo. In comparative example C7, the ratio of Fe/Co is approximately 50.32/46.44 (or 1.083). In comparative example C7, the magnetic flux density is 2.36 T.

Comparative example C7 may be compared to sample S7, in one embodiment, which is based on comparative example C7 and further includes 1.5 wt % of Sm. For instance, sample S7 includes 48.07 wt % of Fe, 46.83 wt % of Co, 2.00 wt % of V, 1.50 wt % of Sm, 0.8 wt % of Nb, and 0.8 wt % of Mo. As seen in FIG. 1, the addition of Sm to sample S7 as compared to comparative example C7 facilitates an increase in magnetic flux density. For example, sample S7 has a magnetic flux density of 2.57 T.

Comparative example C8, in still yet another example embodiment, includes 49.39 wt % of Fe, 48.11 wt % of Co, 1.8 wt % of V, 0.3 wt % of Nb, 0.3 wt % of Mo, 0.05 wt % of Mn, and 0.05 wt % of Si. In comparative example C8, the ratio of Fe/Co is approximately 50.69/46.78 (or 1.083), similar to that of comparative example C7. In comparative example C8, the magnetic flux density is 2.49 T.

Comparative example C8 may be compared to sample S8, in one embodiment, which is based on comparative example C8 and further includes 1.3 wt % of Sm. For instance, sample S8 includes 48.07 wt % of Fe, 46.83 wt % of Co, 1.3 wt % of Sm, 1.8 wt % of V, 0.3 wt % of Nb, 0.3 wt % of Mo, 0.05 wt % of Mn, and 0.05 wt % of Si. As seen in FIG. 1, the addition of Sm to sample S8 as compared to comparative example C8 facilitates an increase in magnetic flux density. For example, sample S8 has a magnetic flux density of 2.79 T.

In accordance with the embodiments described herein, various Fe—Co—V alloys include an addition of Sm. Typically, when addition elements such as, and without limitation, B, C, Cr, Mn, Mo, Nb, Ni, Ti, W, and Si to Fe—Co—V alloys, the processability of the alloys may increase. However, the magnetic flux density in these scenarios may decrease. The addition of Sm to such materials, as described herein, further achieves an increase in magnetic flux density without sacrificing processability of the alloy.

The Fe—Co—V alloy including Sm may be used for various industrial applications including, but not limited to, high-performance transformers, advanced power generating units, track pads for mobile devices, advanced solenoid valves, and the like. The magnetic alloy described herein further provides improvement to the fields of use due to the reduced weight of the alloy, which, at the same time, has substantially the same magnetic specifications. Decreasing the magnetic alloy's weight is of particular importance when the alloy is employed for engine-related application, solenoid valves, and motors used in aerospace and electrical vehicle industries.

Figure 2:
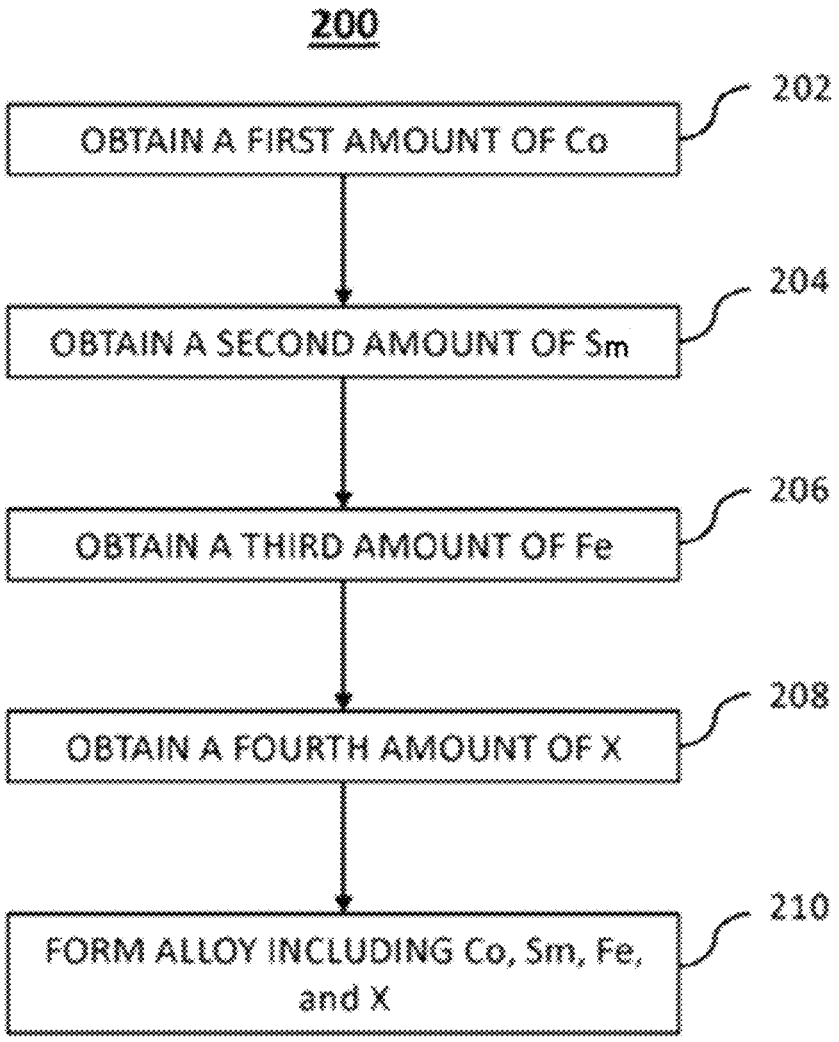
FIG. 2 is an illustrative flowchart of an exemplary process for forming a magnetic alloy, in accordance with various embodiments of the present teachings.

FIG. 2 is an illustrative flowchart of an exemplary process for forming a magnetic alloy, in accordance with various embodiments of the present teachings. Process 200 of FIG. 2 may, in some embodiments, begin at step 202. At step 202, a first amount of Co may be obtained. For example, an amount of Co may be obtained such that a resulting alloy may include 15 wt % to 55 wt % of Co. At step 204, a second amount of Sm may be obtained. For example, an amount of Sm may be obtained such that a resulting alloy may include 0.1 wt % to 2.5 wt % of Sm. At step 206, a third amount of Fe may be obtained. For example, an amount of Fe may be obtained such that a resulting alloy may include 35 wt % to 75 wt % of Fe. At step 208, a fourth amount of at least one element X may be obtained. For example, an amount of at least one element X may be obtained such that a resulting alloy may include 0.001 wt % to 10 wt % of X. In some embodiments, element X may be selected from a group including V, B, C, Cr, Mn, Mo, Nb, Ni, Ti, W, and Si. At step 210, an alloy, such as a magnetic alloy, may be formed including Co, Sm, Fe, and X. In some embodiments, the magnetic alloy may be formed using arc melding. In another embodiment, the magnetic alloy may be formed via powder metallurgy and induction melting, followed by rolling or forging.

While there have been described herein soft magnetic alloys, it is to be understood that many changes may be made therein without departing from the spirit and scope of the present teachings. Insubstantial changes from the claimed subject matter as viewed by a person of ordinary skill in the art, now known or later devised, are expressly contemplated as being equivalently within the scope of the claims. Therefore, obvious substitutions now or later known to one with ordinary skill in the art are defined to be within the scope of the defined elements.

The described embodiments of the present teaching are presented for the purpose of illustration and not of limitation.

What is claimed is:

1. An Iron ("Fe")-Cobalt ("Co") magnetic alloy comprising:

15 wt % to 55 wt % of Co;

0.25 wt % to 2 wt % of Sm;

35 wt % to 75 wt % of Fe;

at least one element X, wherein the magnetic alloy comprises 0.001 wt % to 10 wt % of X, and wherein X is selected from a group comprising V, B, C, Cr, Mn, Mo, Nb, Ni, Ti, W, and Si; and a magnetic flux density of at least 2.5 T.

* * * * *